US007093444B2

(12) United States Patent
Lee et al.

(10) Patent No.: US 7,093,444 B2
(45) Date of Patent: Aug. 22, 2006

(54) SIMULTANEOUS COMBUSTION WITH PREMIXED AND NON-PREMIXED FUELS AND FUEL INJECTOR FOR SUCH COMBUSTION

(75) Inventors: Byeong-Jun Lee, Daegu (KR); Jin-Hyun Kim, Daegu (KR)

(73) Assignee: Yeungnam Educational Foundation, (KR)

( * ) Notice: Subject to any disclaimer, the term of this patent is extended or adjusted under 35 U.S.C. 154(b) by 0 days.

(21) Appl. No.: 11/058,124

(22) Filed: Feb. 14, 2005

(65) Prior Publication Data

US 2005/0144951 A1 Jul. 7, 2005

Related U.S. Application Data

(63) Continuation-in-part of application No. 10/813,924, filed on Mar. 31, 2004.

(30) Foreign Application Priority Data

Dec. 20, 2003 (KR) ..... 10-2003-0094260

(51) Int. Cl.
*F02C 7/22* (2006.01)
*F02C 7/26* (2006.01)

(52) U.S. Cl. ..... 60/776; 60/737; 60/740; 60/39.27

(58) Field of Classification Search ..... 60/737, 60/776, 739, 740, 746, 747, 39.27; 431/280, 431/281, 278, 8, 10, 284, 12, 285
See application file for complete search history.

(56) References Cited

U.S. PATENT DOCUMENTS 4,610,625 A * 9/1986 Bunn ..... 431/284
4,982,570 A * 1/1991 Waslo et al. ..... 60/733
5,024,055 A * 6/1991 Sato et al. ..... 60/39.27
5,327,718 A * 7/1994 Iwata et al. ..... 60/773
5,349,812 A * 9/1994 Taniguchi et al. ..... 60/39.23
5,533,329 A * 7/1996 Ohyama et al. ..... 60/773
5,584,171 A * 12/1996 Sato et al. ..... 60/773
5,660,045 A * 8/1997 Ito et al. ..... 60/737
5,878,566 A * 3/1999 Endo et al. ..... 60/773
6,026,644 A * 2/2000 Ito et al. ..... 60/737
6,070,411 A * 6/2000 Iwai et al. ..... 60/737
6,109,038 A * 8/2000 Sharifi et al. ..... 60/737
6,189,320 B1 * 2/2001 Poeschl et al. ..... 60/737
6,238,206 B1 * 5/2001 Cummings et al. ..... 431/181

(Continued)

FOREIGN PATENT DOCUMENTS

KR 2003-0047146 6/2003

*Primary Examiner*—William Rodriguez
(74) *Attorney, Agent, or Firm*—Knobbe, Martens, Olson & Bear, LLP

(57) ABSTRACT

The present invention relates to a premixed fuel injector for low NOx emission and high heating load combustion. The premixed fuel injector of the present invention comprises a center nozzle and a plurality of outer nozzles arranged around the center nozzle, wherein a distance between the adjacent outer nozzles is 15 to 25 times as large as the diameter of the outer nozzle. Further, an air/fuel mixture is supplied to the outer nozzles and fuel is supplied to the center nozzle at a level of 0.1 to 10% of the total amount of fuel supplied to the outer nozzles. According to the premixed fuel injector for high heating load combustion in which nozzles are arranged as described above, there are various advantages in that it's simple, without additional devices, stable flames can be obtained, and NOx emissions are greatly reduced during combustion.

26 Claims, 4 Drawing Sheets

U.S. PATENT DOCUMENTS 6,397,602 B1 * 6/2002 Vandervort et al. ..... 60/737
6,442,928 B1 * 9/2002 Endo et al. ..... 60/39.27
6,530,223 B1 * 3/2003 Dodds et al. ..... 60/746
6,598,383 B1 * 7/2003 Vandervort et al. ..... 60/773
6,742,338 B1 * 6/2004 Tanaka et al. ..... 60/737
2002/0152751 A1 * 10/2002 Mandai et al. ..... 60/746
2003/0014976 A1 * 1/2003 Mandai et al. ..... 60/737
2004/0035114 A1 * 2/2004 Hayashi et al. ..... 60/737

* cited by examiner

SIMULTANEOUS COMBUSTION WITH PREMIXED AND NON-PREMIXED FUELS AND FUEL INJECTOR FOR SUCH COMBUSTION

RELATED APPLICATIONS

This application is a continuation-in-part application of U.S. patent application Ser. No. 10/813,924, filed Mar. 31, 2004, now pending, which claims foreign priority based on Korean Patent Application No. 10-2003-0094260, filed Dec. 20, 2003. The disclosure and communications of the foregoing applications are hereby incorporated herein by reference in their entirety.

BACKGROUND OF THE INVENTION

1. Field of the Invention

In the above-method of combustion, the non-premixed fuel contains a combustible material and substantially free of an oxidizer. If the non-premixed fuel contains an oxidizer, the amount of the oxidizer is in an amount smaller than about 0.5% of the amount that is minimally required to completely oxidize the combustible material therein. The premixed fuel may be a mixture comprising an oxidizer and at least one combustible material. The non-premixed fuel comprises the at least one combustible material. The method may further comprise supplying an oxidizer through at least one nozzle into the chamber. The non-premixed fuel may be supplied into the combustion chamber through a plurality of nozzles.

2. Description of the Related Art

In general, flames used in gas fuels are broadly classified into a non-premixed flame (diffusion flame) in which air and fuel are separately supplied and a premixed flame in which air is beforehand mixed with fuel and the air/fuel mixture is supplied.

In non-premixed flames (diffusion flames), the range of stable flame conditions is wide but smoke is likely to be produced. In premixed flames, however, NOx emissions can be easily controlled but there is a risk of backfire or blowout. Since great importance has recently been attached to environmental pollution, emission characteristics of pollutants as well as flame stability have been considered major factors for the design and development of combustors.

As a method for reducing NOx emissions, a method for reducing combustion temperature through burnt gas recirculation, a method for performing multi-stage combustion and the like are well known in the art. The method for reducing combustion temperature through burnt gas recirculation has a problem in that it can reduce NOx emissions but requires additional design and devices for burnt gas recirculation. Further, the method for performing multi-stage combustion has been widely employed but still has a problem in that the relevant devices and their operation are complicated.

Recently, combustors tend to require high heating loads, compact size and light weight, and little environmental pollution emission. Thus, researchers and companies in combustion fields aim to develop a high efficiency, low pollution combustion technology and to put such technology to practical use.

In case of the high load combustion, combustion should be produced in a high-velocity flow field in which strong turbulence has occurred, but flames may either be extinguished due to high shear strain rates or become unstable due to abnormalities of combustion flow characteristics.

Therefore, this may lead to more serious problems since more pollutants can be discharged and the combustion efficiency can also be reduced.

In particular, Japanese Patent Laid-open Publication No. (Hei) 7-103428 discloses a technology in which an oxygen nozzle for injecting oxygen-enriched air at high speed is installed in a central portion of a burner and fuels are injected through a plurality of nozzles installed on an outer concentric circle of the oxygen nozzle. In such a type of burner, combustion gas is introduced into a furnace as the air (oxygen) is injected at a high speed. Thus, the temperature of combustion gas in the vicinity of a burner outlet and the concentration of oxygen within the combustion air can be reduced so that the NOx emissions are reduced. Recently, this technology has been widely studied as a method for reducing NOx emissions due to high temperature combustion.

However, this technology has a problem in that it cannot be applied to practical use since its minimum NOx emission is 200 ppm or more. Furthermore, the methods for performing multi-stage combustion and the burnt gas recirculation as an existing method for reducing the NOx emissions have problems in that the production costs are high and workability and manufacturability are lowered due to the complex structures of relevant devices.

SUMMARY OF THE INVENTION

One aspect of the present invention provides a method of combustion. The method comprises supplying a premixed fuel through at least one nozzle into a combustion chamber; supplying a non-premixed fuel through at least one nozzle into the combustion chamber; and simultaneously burning the premixed and non-premixed fuel in the combustion chamber. The premixed fuel comprises an oxidizer.

In the above-described method of combustion, the non-premixed fuel may comprise an oxidizer in an amount substantially smaller than that is needed to completely oxidize a total amount of a combustible material contained therein. The premixed fuel may be a mixture comprising an oxidizer and at least one combustible material. The non-premixed fuel comprises the at least one combustible material. The method may further comprise supplying an oxidizer substantially free of a combustible material through at least one nozzle into the chamber. The non-premixed fuel may be supplied into the combustion chamber through a plurality of nozzles.

In the above-described method, the premixed fuel may be supplied into the chamber through a plurality of nozzles, which may be arranged such that the plurality of the nozzles as a whole substantially surround the at least one nozzle for supplying the non-premixed fuel. At least a portion of the plurality of nozzles for supplying the premixed fuel may be separated from the at least one nozzle for supplying the non-premixed fuel by substantially the same distance. At least a portion of the plurality of nozzles for supplying the premixed fuel may be arranged on an imaginary circle surrounding the at least one nozzle for supplying the non-premixed fuel. The at least one nozzle for supplying the non-premixed fuel may be located on or near the center of the imaginary circle. Each of the nozzles on the imaginary circle may be spaced apart from neighboring nozzles on the imaginary circle by substantially the same distance. Each of the nozzles for supplying the premixed fuel may have a substantially circular opening with a diameter configured to inject the premixed fuel into the chamber, and wherein a ratio of the distance between neighboring nozzles to the diameter may be from about 3 to about 28. The ratio may be from about 15 to about 25.

Still in the above-method, a ratio of an amount of the non-premixed fuel to the total amount of fuel contained in the premixed fuel may be from about 0.001 to about 0.1. The at least one nozzle for the premixed fuel and the at least one nozzle for the non-premixed fuel may be formed in a single piece fuel injector. The method further supplies the premixed fuel and non-premixed fuel using a plurality of the single piece fuel injectors, each of which comprises the at least one premixed fuel nozzle and the at least one non-premixed fuel nozzle.

Another aspect of the present invention provides a burner, which comprises: a combustion chamber; at least one premixed fuel nozzle configure to supply a premixed fuel into the chamber; at least one non-premixed fuel nozzle configured to supply a non-premixed fuel into the chamber; at least one premixed fuel pipe connecting the at least one premixed fuel nozzle with a premixed fuel source; at least one non-premixed fuel pipe connecting the at least one non-premixed fuel nozzle with a non-premixed fuel source; and a controller to control operation of the burner. The controller is configured to operate the burner in one or more modes, in which the premixed fuel is supplied to the chamber through the at least one premixed fuel nozzle and the non-premixed fuel is supplied to the chamber through the at least one non-premixed fuel nozzle.

The above-described burner further comprises a mixer configured to mix an oxidizer with the non-premixed fuel from the non-premixed source to produce the premixed fuel, wherein the mixer may be the premixed fuel source. The burner may comprise a plurality of premixed fuel nozzles, and wherein the plurality of premixed fuel nozzles may be arranged so as to surround the at least one non-premixed fuel nozzle. At least a portion of the plurality of premixed fuel nozzles may be arranged on an imaginary circle surrounding the at least one non-premixed fuel nozzle. The at least one non-premixed fuel nozzle may be located on or near the center of the imaginary circle. Each of the nozzles on the imaginary circle may be spaced apart from neighboring nozzles on the imaginary circle by substantially the same distance. Each premixed fuel nozzle may have a substantially circular opening with a diameter configured to inject the premixed fuel into the chamber, and wherein a ratio of the distance between neighboring nozzles to the diameter may be from about 3 to about 28. The ratio may be from about 15 to about 25.

Still in the above-described burner, the at least one non-premixed fuel nozzle and the at least one premixed fuel nozzle may be configured to inject the non-premixed fuel and the premixed fuel at a ratio of an amount of the non-premixed fuel to the total amount of the fuel contained in the premixed fuel ranging from about 0.001 to about 0.1. The at least one premixed fuel nozzle and the at least one non-premixed fuel nozzle may be formed in a single piece fuel injector. The burner may comprise a plurality of the single piece fuel injectors, each of which comprises the at least one premixed fuel nozzle and the at least one non-premixed fuel nozzle.

Another aspect of the present invention is to provide a simplified premixed fuel injector for low NOx emission and high heating load combustion, having flame characteristics and combustion modes capable of performing low pollution and high heating load combustion in a gas fuel combustor. More specifically, the aspect provides an environmentally-friendly premixed fuel injector for low NOx emission and high heating load combustion capable of maximizing flame stability by optimizing nozzle arrangement of the fuel injector and improving its operating scheme and of reducing NOx emissions through interaction with the premixed combustion.

According to an aspect of the present invention, there is provided a premixed fuel injector, comprising: a center nozzle; and a plurality of outer nozzles arranged around the center nozzle, wherein a distance between the adjacent outer nozzles is 15 to 25 times as large as the diameter of the outer nozzle. The center nozzle may have a diameter different from that of the outer nozzles. An air/fuel mixture may be supplied to the outer nozzles and fuel is supplied to the center nozzle at a level of 0.1 to 10% of the total amount of fuel supplied to the outer nozzles.

The test results of the present invention are provided only for easy understanding of the present invention, and the nozzle arrangement, concentration and flow conditions of the present invention may be changed in various manners. Further, it is apparent that they cannot be limited to specific values.

BRIEF DESCRIPTION OF THE DRAWINGS

The above and other features and advantages of the present invention will become apparent from the following description of preferred embodiments given in conjunction with the accompanying drawings, in which.

DETAILED DESCRIPTION OF THE INVENTION

Figure 1:
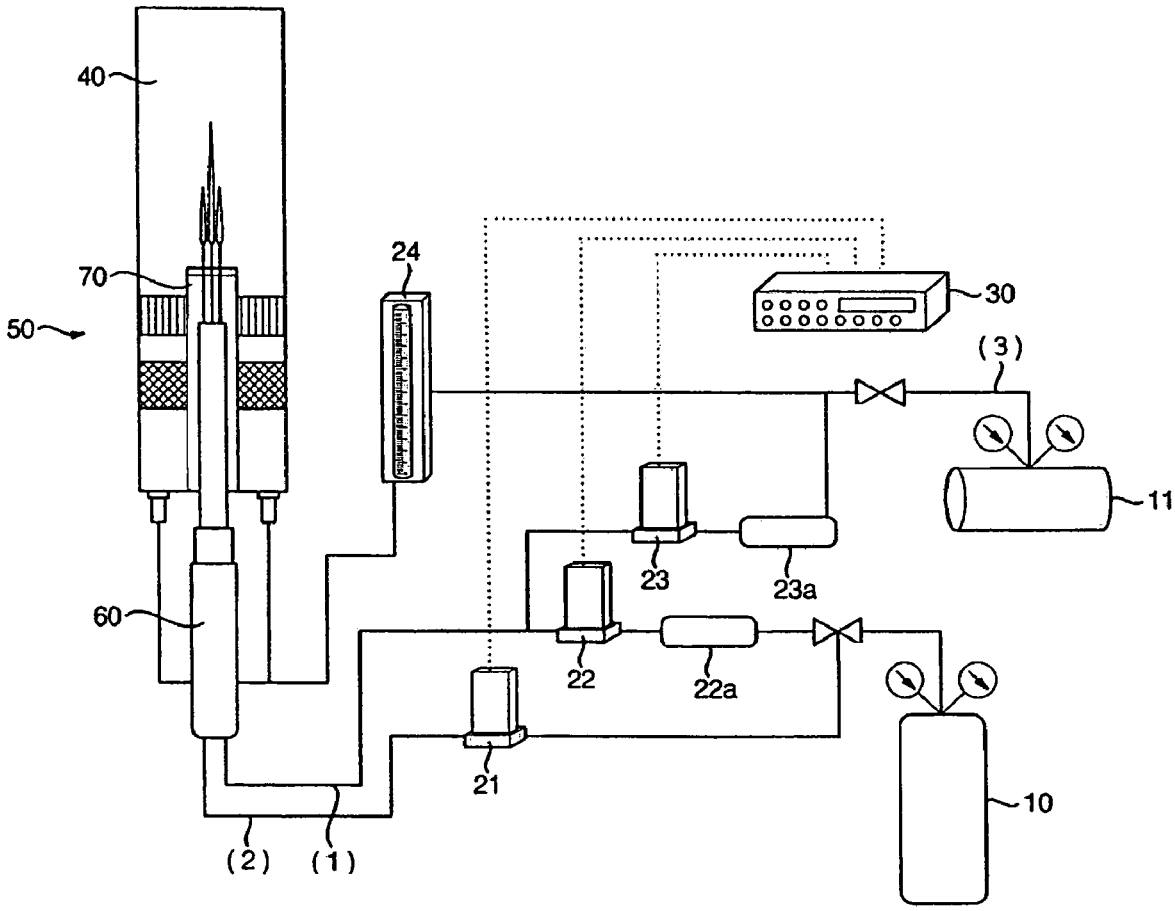
FIG. 1 is a view showing the configuration of a test apparatus for examining the characteristics of a premixed fuel injector for low NOx emission and high heating load combustion according to an embodiment of the present invention.

Hereinafter, the configuration and advantageous effects of a premixed fuel injector for low NOx emission and high heating load combustion according to the present invention will be described in detail with reference to the accompanying drawings.

The term "non-premixed fuel" refers to a fuel material containing a combustible material and substantially free of an oxidizer, such as oxygen. The oxidizer, if contained in the non-premixed fuel, is in an amount that is substantially smaller than that is needed to completely oxidize the combustible material of the non-premixed fuel. For example, the non-premixed fuel may contain an oxidizer in an amount smaller than about 0.5% of the amount that is needed completely oxidize the combustible material contained therein. The "premixed fuel" refers to a fuel material containing a combustible material and a substantial amount of an oxidizer. A premixed fuel may be fully or partially premixed with an oxidizer. A fully premixed fuel may contain an oxidizer in an amount substantially the same as or a little less or more than the amount needed to completely oxidize the combustible material contained therein. A partially premixed fuel contains an oxidizer in an amount less than the amount needed to completely oxidize the combustible material, while the amount of the oxidizer contained therein is substantially more than the non-premixed fuel. For example, a partially premixed fuel may contain about 80% of the amount of oxidizer that is needed to completely oxidize the combustible material contained therein. Optionally, the partially premixed fuel may contain an oxidizer about or more than 50%, 30%, 20%, 10%, 5%, 3% or 1% of the amount of oxidizer that is needed to completely oxidize the combustible material contained therein.

The total amount of the oxidizer supplied from the premixed and non-premixed fuels may be determined as sufficient to completely oxidize the combustible material supplied from the premixed and non-premixed fuels. Alternatively, the total amount of the oxidizer supplied from both of the non-premixed and premixed fuels may be less than that is sufficient to completely oxidize the combustible materials supplied from the non-premixed and premixed fuels. An oxidizer may be separately supplied to a burning area. Additionally or alternatively, oxygen from the air can participate in the burning of the combustible materials. One of ordinary skill in the art would appreciate the determination of the amount of an oxidizer to be contained in the premixed and/or non-premixed fuels, depending upon the construction of a burner.

The total amount of the oxidizer supplied to a combustion chamber or area may be sufficient to completely oxidize the combustible material supplied from the premixed and non-premixed fuels. Alternatively, the total amount of the oxidizer supplied to the combustion chamber or area may be less than that is sufficient to completely oxidize the combustible materials supplied from the non-premixed and premixed fuels. An oxidizer may be separately supplied to the combustion chamber or area. Additionally or alternatively, oxygen from the air can participate in the burning of the combustible materials. One of ordinary skill in the art would appreciate the determination of the amount of an oxidizer to be contained in the premixed and/or non-premixed fuels, depending upon the construction of a burner.

Referring to FIG. 1, an exemplary test apparatus configured to examine the characteristics of the premixed fuel injector for low NOx emission and high heating load combustion according to the present invention comprises a fuel tank 10, an air compressor 11, a flow meter 24, flow control valves 21, 22 and 23, a 4-channel reader 30, a combustion tube 50 including a glass tube 40 used for NOx measurement and an air/fuel distribution chamber 60, and a plurality of conduits for forming a predetermined circuit between the above devices. Air and fuel, each of which the flow rate is controlled by the flow control valves 22 and 23, are mixed with each other and fed to a plurality of outer nozzles surrounding the center of the fuel injector in the combustion tube 50 through the supply conduit 1 and the distribution chamber 60. Further, fuel of which flow rate is controlled by the flow control valve 21 is fed to a center nozzle directly through the supply conduit 2. The glass tube 40 was used only for the NOx measurement. In such a case, an average flow velocity of air supplied for the combustion was set to be 0.85 m/s between the combustion tube 50 and a nozzle supporting tube 70 by using a flow meter 24. Here, reference numerals 22*a* and 23*a*, which are not yet explained, designate controllers for controlling the flow rates supplied to the flow control valves 22 and 23, respectively.

To achieve the aforementioned object, such a test apparatus is used to control the optimized arrangement of the fuel injection nozzles and the proper concentration and injection speed of the fuel injected from the center nozzle.

Figure 2:
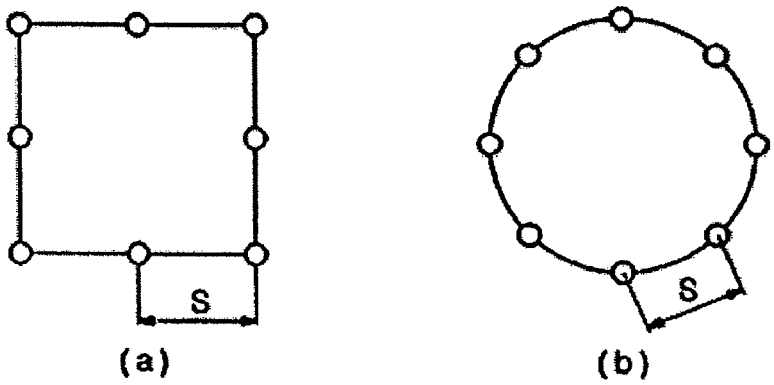
FIG. 2 Prior Art
FIG. 2 is a schematic view showing the nozzle arrangement of the related art non-premixed burner for high heating load combustion with no center nozzle mounted thereto, as viewed from above.

FIG. 2 shows the arrangement of a plurality of nozzles as viewed from above the fuel injector disposed in the combustion tube 50 covered with the glass tube 40, wherein (a) shows the rectangular arrangement and (b) shows the circular arrangement. In the fuel injectors having the nozzle arrangements shown in FIG. 2, the flames from the injectors are stable even at a fuel injection speed of 204 m/s, as described in Korean Patent Laid-open Publication No. 2003-0047146. However, these arrangements are merely for use in a non-premixed and high heating load burner only for injecting the fuel into the atmosphere. Thus, if a premixed air/fuel mixture for low pollution combustion is supplied to these arrangements, desired high heating load combustion cannot be accomplished because the flames are extinguished at a lower flow rate.

Figure 3:
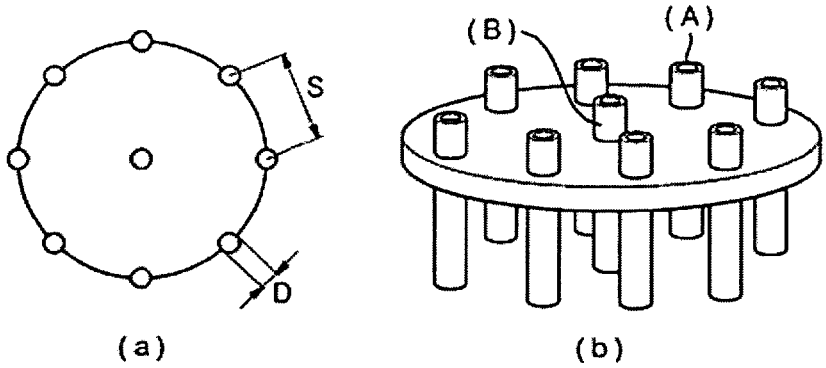
FIG. 3 is a schematic view showing the multiple nozzle arrangement of the premixed fuel injector for low NOx emission and high heating load combustion with the center nozzle mounted thereto according to an embodiment of the present invention.

To simultaneously solve these problems regarding the flame stability and low pollution control, therefore, the present invention has employed an arrangement of multiple nozzles with an injection nozzle disposed at the center thereof, as shown in FIG. 3.

The air/fuel gaseous mixture injected from the supply conduit 1 of FIG. 1 is fed to outer nozzles A, whereas the fuel (or fuel with a small amount of oxidants added thereto) injected from the supply conduit 2 of FIG. 1 is fed to a center nozzle B.

As defined in a conventional non-premixed and high heating load burner, a non-dimensional number obtained by dividing a distance ("S") between the center of two adjacent nozzles by a diameter ("D") of the outer nozzle is expressed as S/D.

The nozzle arrangement of the multiple nozzle flame burner is similar to that of the related art, except that a nozzle is added at the center of the burner plate. The outer nozzles A are supplied with an air/fuel mixture so as to reduce NOx emissions. The amount of non-premixed fuel supplied to the center nozzle B is kept at a level of 0.1 to 10.0% of the total amount of fuel contained in the premixed fuel supplied to the outer nozzles A. If the same concentration and flow rate of fuel as supplied to the outer nozzle is supplied to the center nozzle B, the high heating load combustion cannot be accomplished because the flames are blown out even at a lower flow rate.

The aforementioned arrangement, the ratio of flowrate of air to a flowrate of fuel, and the ratio of the flow velocity of outer nozzles to the flow velocity of a center nozzle can allow the flames not to be blown out even at a higher flow velocity in the same manner as in a case of the non-premixed combustion.

When methane ($CH_4$) was used as fuel, its flames were not blown out even at a flow velocity of 215 m/s at the nozzle exit. Such operating conditions allow the relevant devices to be simplified without needing to increase total costs. Thus, it is very practical and economical (see FIG. 7).

Figure 4A:
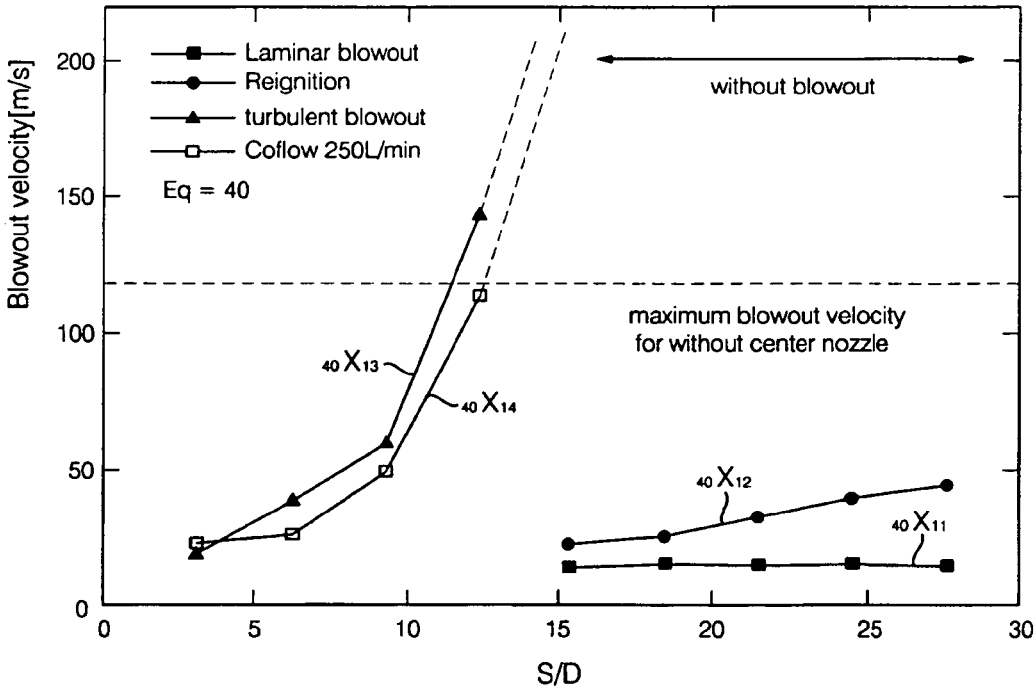
FIGS. 4*a* and 4*b* are graphs showing blowout characteristics when propane fuel is used.
Figure 4B:
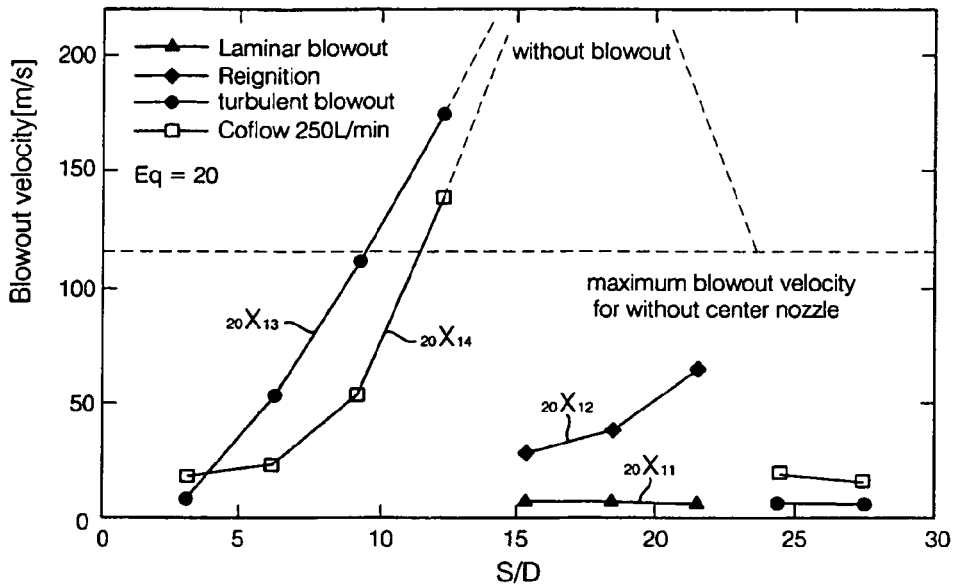

FIGS. 4*a* and 4*b* are graphs showing a blowout velocity when equivalence ratios (weight ratio of fuel to oxidizer of an actual mixture divided by the ratio of a stoichiometric mixture) are 40 and 20, respectively. Here, the propane fuel was used. In these figures, $_{40}X_{11}$ and $_{20}X_{11}$ represent velocities when laminar blowout occurs; $_{40}X_{12}$ and $_{20}X_{12}$ represent blowout velocities when re-ignition occurs; $_{40}X_{13}$ and $_{20}X_{13}$ represent blowout velocities when turbulent blowout occurs; and $_{40}X_{14}$ and $_{20}X_{14}$ represent blowout velocities when inflow of external air are prevented by using the glass tube and air with a flow rate of 250 L/min (an average flow velocity of 0.85 m/s in a space between the combustion tube 50 and the nozzle supporting tube 70) was supplied by using the flow meter 24.

Further, the premixed air/fuel mixture is supplied to the, outer nozzle A, and 40% of the fuel supplied to one of the outer nozzles is supplied to the center nozzle B. Here, a horizontal line represents a maximum blowout velocity when there is no center nozzle B.

It can be understood from the test made under the above conditions that when a S/D value is between 3 to 12, the blowout velocity is increased as the distance between nozzles are increased. Further, the blowout velocity is increased due to the increase of the S/D value when the S/D value is greater than 12, whereas the blowout does not occur even though choking phenomenon occurs at the outlet of the nozzle when the S/D value is greater than 15. Furthermore, when the S/D value is between 15 (15 for eq=20) to 27 (22 for eq=20), the laminar blowout and reignition phenomena occur, As such, FIGS. 4*a* and 4*b* show that when the premixed propane fuel having the aforementioned air/fuel ratio is supplied to the outer and center nozzles, the flame is stable and blowout does not occur at higher velocities (or higher flow rates) even in an interval where the S/D value is within a range of between 15 to 25. That is, it is shown that blowout does not occur in a predetermined arrangement even at a velocity of 215 m/s or more.

As described above, when a small amount of fuel is supplied to the center nozzle B, there exists an interval where blowout does not occur. Therefore, the high heating load combustion can be obtained by controlling the amount of fuel supplied to the center nozzle B. Further, both external air entrained by high-speed jet from the outer nozzles A and center nozzle B and air in the premixed air/fuel mixture are supplied to the flame.

Figure 5:
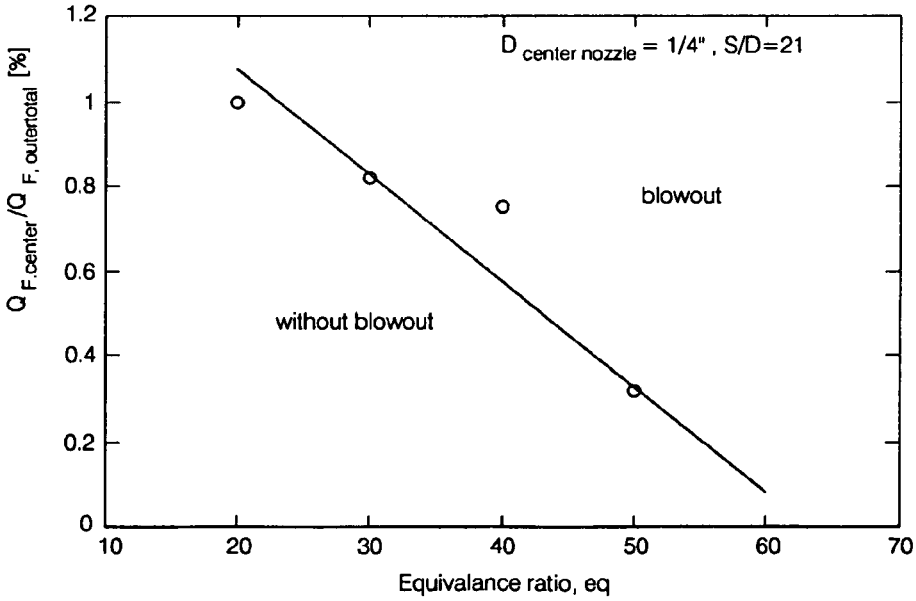
FIG. 5 is a graph showing effects of the degree of premixing and fuel flow rate of the center nozzle on the blowout when the diameter of the center nozzle is different from that of the outer nozzle.

FIG. 5 is a graph showing without-blowout regions as functions of the equivalence ratio of the outer nozzle and the fuel supplied to the center nozzle when the flow velocity of the outer nozzle is 215 m/s and the diameter of the center nozzle is larger than that of the outer nozzles.

It can be seen that the flame is not blown out when the center nozzle is greater in diameter than the outer nozzle, e.g. diameter of the center nozzle is 0.25 inch, the S/D value is 21, the flowrate of the center nozzle is within a range of 0.1 to 1.0% of a total fuel flow rate of the outer nozzle and the equivalence ratio is between 20 to 60.

Figure 6:
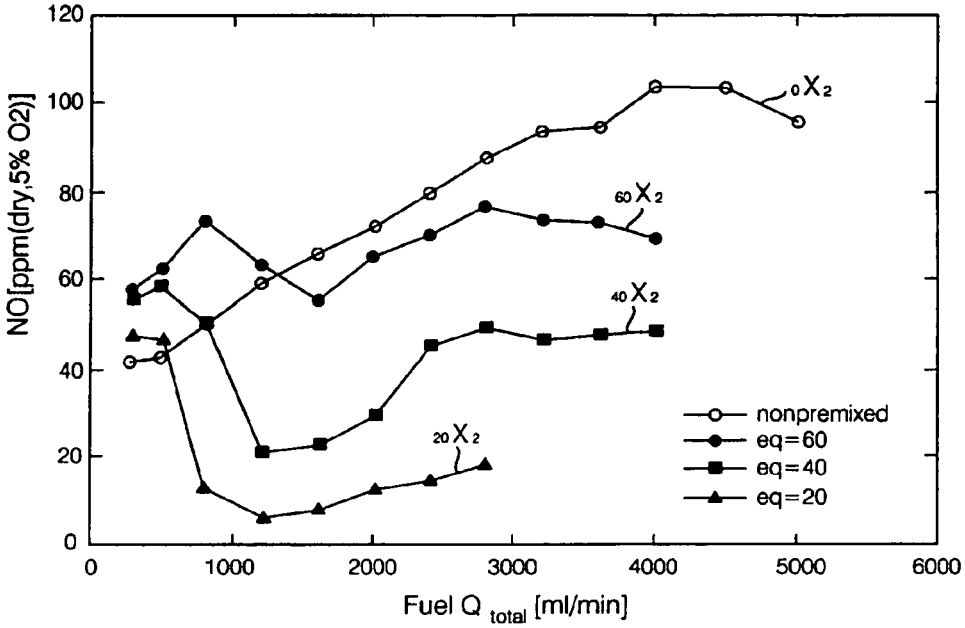
FIG. 6 is a graph showing the concentrations of NOx emission from non-premixed and premixed flames.

The NOx reduction characteristics of the present invention have been shown in FIG. 6. In this figure, $_{0}X_{2}$ represents the NOx emission from at the non-premixed condition; $_{20}X_{2}$, $_{40}X_{2}$ and $_{60}X_{2}$ represent the NOx emission when the equivalence ratios are 20, 40 and 60, respectively.

It can be seen from this figure that NOx emissions in the premixed combustion were reduced by 20 to 70% as compared with the non-premixed combustion in which the air and fuel are not beforehand mixed with each other.

Further, since NOx emissions are lower than 100 ppm even in case of higher flow rate (high-speed combustion), it is very environmentally-friendly and practical.

Figure 7:
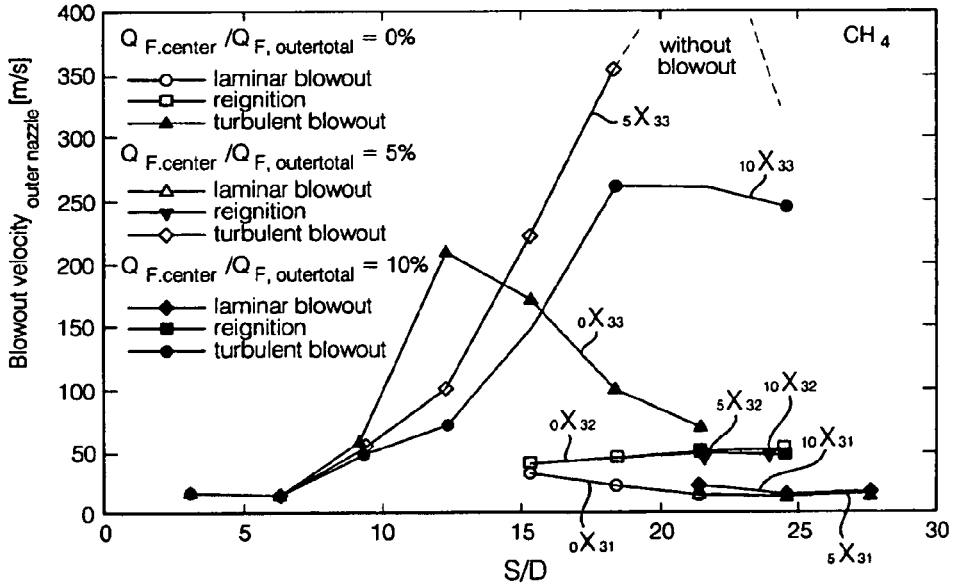
FIG. 7 is a graph showing blowout characteristics when methane fuel is used.

FIG. 7 shows that the flame is stable and that blowout does not occur even at a higher flow rate if the concentration conditions of the present invention are employed to methane ($CH_4$) fuel in the arrangement where the center nozzle is provided instead of the arrangement where the center nozzle is not provided. In this figure, $_{0}X_{31}$, $_{0}X_{32}$ and $_{0}X_{33}$ represent a laminar blowout velocity, a reignition blowout velocity and a turbulent blowout velocity, at the non-premixed condition, respectively. Further, $_{5}X_{31}$, $_{5}X_{32}$ and $_{5}X_{33}$ represent a laminar blowout velocity, a reignition blowout velocity and a turbulent blowout velocity, respectively, when 5% of total amount of fuel supplied to outer nozzles is supplied to the center nozzle. Furthermore, $_{10}X_{31}$, $_{10}X_{32}$ and $_{10}X_{33}$ represent a laminar blowout velocity, a reignition blowout velocity and a turbulent blowout velocity, respectively, when 10% of total amount of fuel supplied to outer nozzles is supplied to the center nozzle.

According to the above test results, the optimized arrangement and relevant operating method of the multiple nozzle flame burner according to the present invention have the following advantages.

(1) To satisfy premixed conditions for the development of low pollution burners and avoid blowout even under high-speed combustion, the flame burner of the present invention is configured in such a manner that the outer nozzles are optimally spaced and arranged in the form of a circle or a polygon such as a rectangle and a center nozzle is arranged at the center of the outer nozzles. Further, an air/fuel mixture is supplied to the outer nozzles A of FIG. 3, and the amount of fuel supplied to the center nozzle B of FIG. 3 is kept at a level of 5.0% of the total amount of fuel supplied to the outer nozzles A. In such a case, the flames are stable and blowout does not occur.

(2) The NOx emissions in the above condition (1) is reduced by 20 to 70% when premixed combustion is performed as compared with when non-premixed combustion is performed and it is maintained below 100 ppm at higher flow rates. Thus, it is very practical.

(3) In case of methane fuel, blowout has occurred when the center nozzle is not provided, whereas blowout does not occur even at choking conditions when the center nozzle is provided under the above condition (1). Thus, high heating load combustion can be accomplished.

According to a premixed fuel injector for high heating load combustion of the present invention in which nozzles are arranged as described above, there is an advantage in that it is simple, stable flames can be obtained, and NOx emissions are greatly reduced during combustion.

Accordingly, the energy used can be reduced and the heating mode can also be improved. Further, economic losses due to environmental pollutants can be reduced. Furthermore, the present invention can be applied to a variety of environmentally-friendly application areas.

Although the embodiments of the present invention have been described with reference to the accompanying drawing, it can be understood by those skilled in the art that the present invention can be implemented in the other specific forms without modifying or changing the technical spirit and essential features thereof. Therefore, it should be understood that the aforementioned embodiments are not restrictive but illustrative in all aspects. The scope of the present invention should be defined by the appended claims, and all changes or modifications made from the spirit and scope of the invention and equivalents thereof should be construed as falling within the scope of the invention.

What is claimed is:

1. A method of combustion, comprising:

supplying a premixed fuel through at least one nozzle into a combustion chamber, the premixed fuel comprising an oxidizer;

supplying a non-premixed fuel through at least one nozzle into the combustion chamber;

simultaneously burning the premixed and non-premixed fuel in the combustion chamber; and wherein the non-premixed fuel comprises an oxidizer in an amount less than about 0.5% of the amount of the oxidizer that is needed to completely oxidize a total amount of a combustible material contained therein.

2. The method of claim 1, wherein the non-premixed fuel is substantially free of an oxidizer.

3. The method of claim 1, wherein the premixed fuel is a mixture comprising an oxidizer and at least one combustible material.

4. The method of claim 3, wherein the non-premixed fuel comprises the at least one combustible material.

5. The method of claim 1, further comprising supplying an oxidizer substantially free of a combustible material through at least one nozzle into the chamber.

6. The method of claim 1, wherein the non-premixed fuel is supplied into the combustion chamber through a plurality of nozzles.

7. The method of claim 1, wherein the premixed fuel is supplied into the chamber through a plurality of nozzles, which are arranged such that the plurality of the nozzles as a whole substantially surround the at least one nozzle for supplying the non-premixed fuel.

8. The method of claim 7, wherein at least a portion of the plurality of nozzles for supplying the premixed fuel is separated from the at least one nozzle for supplying the non-premixed fuel by substantially the same distance.

9. The method of claim 7, wherein at least a portion of the plurality of nozzles for supplying the premixed fuel is arranged on an imaginary circle surrounding the at least one nozzle for supplying the non-premixed fuel.

10. The method of claim 9, wherein the at least one nozzle for supplying the non-premixed fuel is located on or near the center of the imaginary circle.

11. The method of claim 9, wherein each of the nozzles on the imaginary circle is spaced apart from neighboring nozzles on the imaginary circle by substantially the same distance.

12. The method of claim 11, wherein each of the nozzles for supplying the premixed fuel has a substantially circular opening with a diameter configured to inject the premixed fuel into the chamber, and wherein a ratio of the distance between neighboring nozzles to the diameter is from about 3 to about 28.

13. The method of claim 12, wherein the ratio is from about 15 to about 25.

14. The method of claim 1, wherein a ratio of an amount of the non-premixed fuel to the total amount of a combustible material contained in the premixed fuel is from about 0.001 to about 0.1.

15. The method of claim 1, wherein the at least one nozzle for the premixed fuel and the at least one nozzle for the non-premixed fuel are formed in a single piece fuel injector.

16. The method of claim 15, wherein the method further supplies the premixed fuel and non-premixed fuel using a plurality of the single piece fuel injectors, each of which comprises the at least one premixed fuel nozzle and the at least one non-premixed fuel nozzle.

17. A burner, comprising:

a combustion chamber;

at least one premixed fuel nozzle configure to supply a premixed fuel into the chamber;

at least one non-premixed fuel nozzle configured to supply a non-premixed fuel into the chamber;

at least one premixed fuel pipe connecting the at least one premixed fuel nozzle with a premixed fuel source;

at least one non-premixed fuel pipe connecting the at least one non-premixed fuel nozzle with a non-premixed fuel source;

a controller to control operation of the burner, wherein the controller is configured to operate the burner in one or more modes, in which the premixed fuel is supplied to the chamber through the at least one premixed fuel nozzle and the non-premixed fuel is supplied to the chamber through the at least one non-premixed fuel nozzle; and a mixer configured to mix an oxidizer with the non-premixed fuel from the non-premixed source to produce the premixed fuel, wherein the mixer is the premixed fuel source.

18. The burner of claim 17, wherein the burner comprises a plurality of premixed fuel nozzles, and wherein the plurality of premixed fuel nozzles are arranged so as to surround the at least one non-premixed fuel nozzle.

19. The burner of claim 18, wherein at least a portion of the plurality of premixed fuel nozzles is located on an imaginary circle surrounding the at least one non-premixed fuel nozzle.

20. The burner of claim 19, wherein the at least one non-premixed fuel nozzle is located on or near the center of the imaginary circle.

21. The burner of claim 19, wherein each one of the plurality of premixed fuel nozzles on the imaginary circle is spaced apart from neighboring premixed fuel nozzles on the imaginary circle by substantially the same distance.

22. The burner of claim 21, wherein each premixed fuel nozzle has a substantially circular opening with a diameter configured to inject the premixed fuel into the chamber, and wherein a ratio of the distance between neighboring nozzles to the diameter is from about 3 to about 28.

23. The burner of claim 22, wherein the ratio is from about 15 to about 25.

24. The burner of claim 17, wherein the at least one non-premixed fuel nozzle and the at least one premixed fuel nozzle are configured to inject the non-premixed fuel and the premixed fuel at a ratio of an amount of the non-premixed fuel to the total amount of a combustible material contained in the premixed fuel ranging from about 0.001 to about 0.1.

25. A burner, comprising:

a combustion chamber;

at least one premixed fuel nozzle configure to supply a premixed fuel into the chamber;

at least one non-premixed fuel nozzle configured to supply a non-premixed fuel into the chamber;

at least one premixed fuel pipe connecting the at least one premixed fuel nozzle with a premixed fuel source;

at least one non-premixed fuel pipe connecting the at least one non-premixed fuel nozzle with a non-premixed fuel source;

a controller to control operation of the burner, wherein the controller is configured to operate the burner in one or more modes, in which the premixed fuel is supplied to the chamber through the at least one premixed fuel nozzle and the non-premixed fuel is supplied to the chamber through the at least one non-premixed fuel nozzle; and wherein the at least one premixed fuel nozzle and the at least one non-premixed fuel nozzle are formed in a single piece fuel injector.

26. The burner of claim 25, wherein the burner comprises a plurality of the single piece fuel injectors, each of which comprises the at least one premixed fuel nozzle and the at least one non-premixed fuel nozzle.

* * * * *